United States Patent [19]

Focke

[11] Patent Number: 4,594,962

[45] **Date of Patent: * Jun. 17, 1986**

[54] APPARATUS FOR SPREADING GLUE ONTO SHEET-LIKE BLANKS

[75] Inventor: Heinz Focke, Verden, Fed. Rep. of Germany

[73] Assignee: Focke & Co., Verden, Fed. Rep. of Germany

[ * ] Notice: The portion of the term of this patent subsequent to Feb. 5, 2002 has been disclaimed.

[21] Appl. No.: 684,314

[22] Filed: Dec. 20, 1984

Related U.S. Application Data

[63] Continuation of Ser. No. 520,767, Aug. 8, 1983, Pat. No. 4,497,274, which is a continuation of Ser. No. 352,981, Feb. 26, 1982, abandoned.

[30] Foreign Application Priority Data

Mar. 4, 1981 [DE] Fed. Rep. of Germany ..... 3108089

[51] Int. Cl.[4] ..... B05C 1/02

[52] U.S. Cl. ..... 118/221; 118/212; 118/225; 118/249; 118/261; 118/247

[58] Field of Search ..... 118/212, 204, 224, 216, 118/249, 221, 219, 225, 261, 247

[56] References Cited

U.S. PATENT DOCUMENTS

| | | | |
|---|---|---|---|
| 1,191,537 | 7/1916 | Schall | 118/249 X |
| 1,999,480 | 4/1935 | Reid | 118/225 X |
| 2,615,422 | 10/1952 | Ackley | 118/221 |
| 2,754,798 | 7/1956 | Tilden | 118/219 X |
| 2,787,244 | 4/1957 | Hickin | 118/259 |
| 3,036,927 | 5/1962 | Jerothe | 118/212 X |
| 3,882,816 | 5/1975 | Booz et al. | 118/221 X |
| 4,055,688 | 10/1977 | Caratsch | 118/212 X |
| 4,106,433 | 8/1978 | Fernando et al. | 118/212 |
| 4,194,030 | 3/1980 | Fassina | 118/212 X |
| 4,497,274 | 2/1985 | Focke | 118/221 |

*Primary Examiner*—John P. McIntosh
*Attorney, Agent, or Firm*—Sughrue, Mion, Zinn, Macpeak, and Seas

[57] ABSTRACT

In spreading glue onto blanks for the manufacture of packs, it is necessary to ensure that the metered amounts of glue spread onto the glue spots are neither too large nor too small. There is therefore a need to provide a glue transfer which is precise in respect of amount of glue, glue pattern and relative positioning. For this purpose, glueing rolls, glueing rollers and glueing segments are used, which in the region of the glue transfer are provided with shallow depressions or recesses, which accommodate limited amounts of glue for transfer onto the blank.

4 Claims, 7 Drawing Figures

Figure 1:
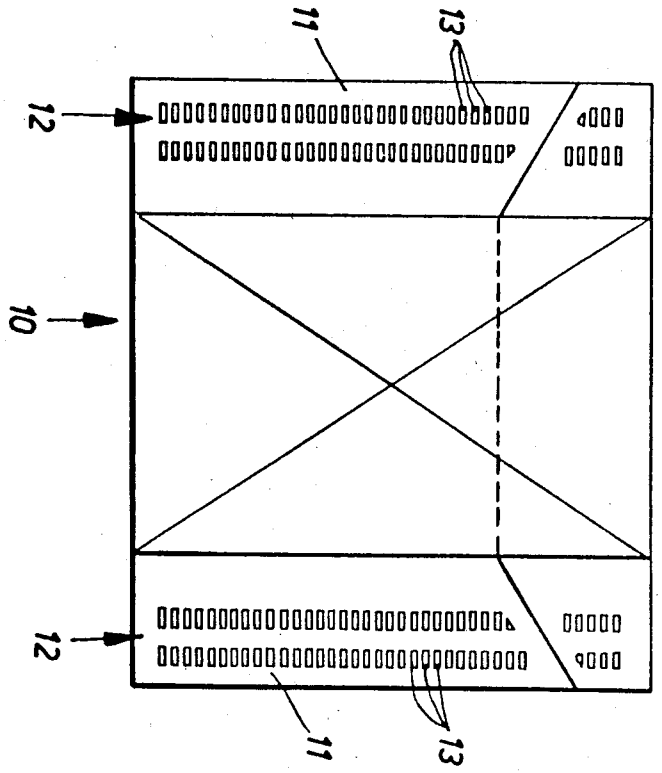

Fig.4
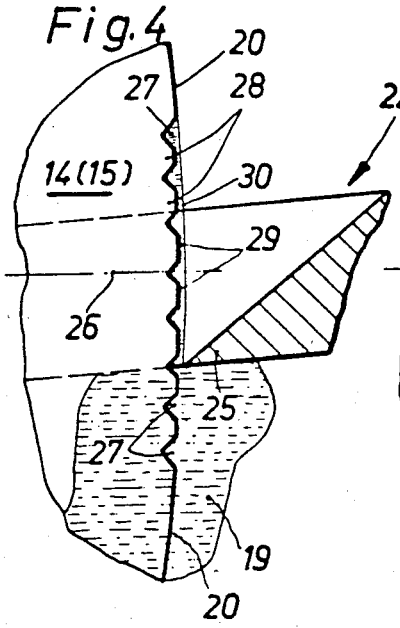
Fig.5
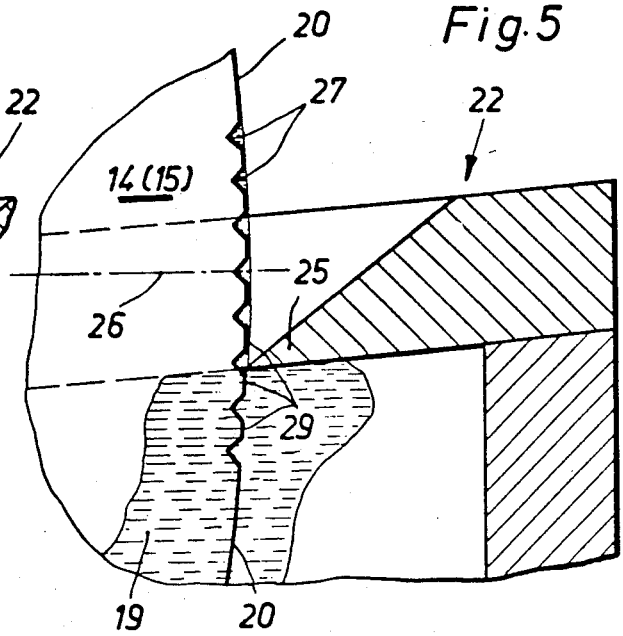
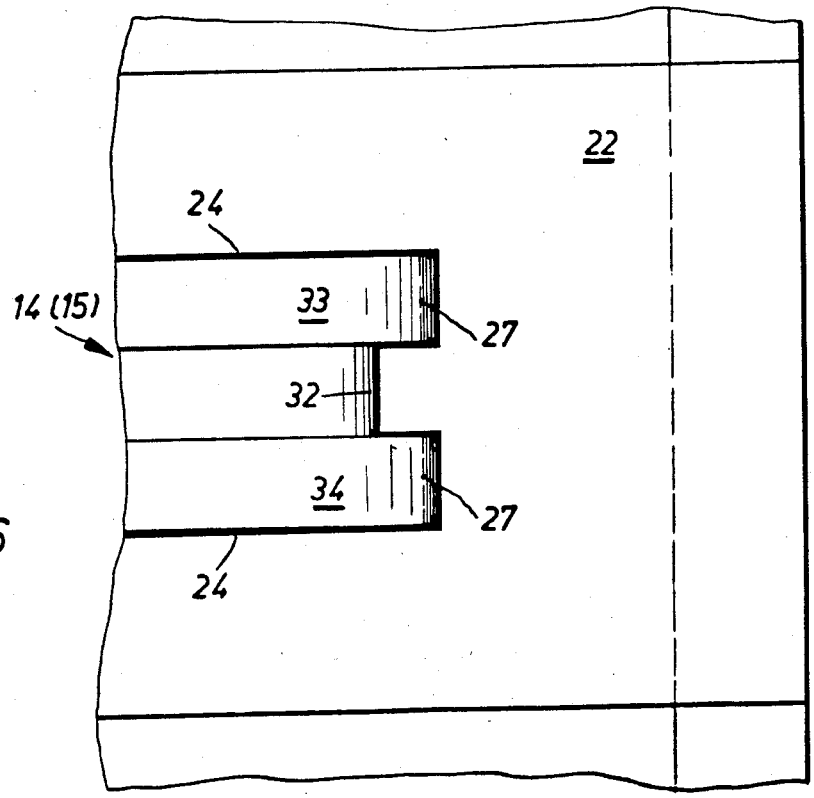
Fig.6

APPARATUS FOR SPREADING GLUE ONTO SHEET-LIKE BLANKS

CROSS REFERENCE TO RELATED APPLICATIONS

The present application is a continuation of application Ser. No. 520,767, filed Aug. 8, 1983, now U.S. Pat. No. 4,497,274, granted Feb. 5, 1985, which in turn is a continuation of application Ser. No. 352,981, filed Feb. 26, 1982, now abandoned.

DESCRIPTION

The invention relates to an apparatus for spreading glue onto sheet-like blanks, especially onto parts of packs, by means of movable or rotatable glue-spreading members (glueing rolls, glueing rollers, glueing segments) which receive glue on a glueing region of an outer or peripheral face and which transfer a glue pattern onto the blank.

The exact, metered transfer of glue onto blanks is a special subject in the packaging industry. The glueing devices used in or on packaging machines have to give high performances, but nevertheless transfer exact glue patterns onto tabs to be glued to one another or onto other parts of blanks.

The glueing devices known hitherto have all been equipped with revolving glue-spreading members, namely glueing rolls or glueing rollers. During rotation, the periphery of these dips into a glue vessel, and they take up on the outer or peripheral face a glue layer metered by means of a scraper. The thin glue layer is then transferred onto the blank which is brought in contact with the periphery of the glue-spreading member. The glue-spreading members in the form of glueing rollers can alternatively have a closed continuous peripheral face as a glueing region. In this case, a continuous and unbroken strip of glue is transferred. Instead of this, individual glueing segments projecting outwards, which transfer limited glue patterns, can be formed on the glueing roller. It is also known to provide the glueing segments, as a glueing region, indirectly with the glue layer, namely by means of a preceding glueing roller which dips into the glue vessel.

The glueing appliances mentioned above are disadvantageous in many respects. It is especially unfavourable that inexact glue patterns are produced because, when the blank comes in contact with the glueing region, glue is squeezed off laterally as a result of the necessary exertion of pressure. Edge regions with surplus glue which are unfavourable for the glueing operation are obtained as a consequence of this. Another disadvantage is that when the machine is stopped, for example during a change of shift or in the case of interruptions caused by faults, the glue layer dries on the glueing region and then has to be carefully removed again at great expense.

The object on which the invention is based is to propose a glueing appliance, especially for packaging machines, which, while giving a high performance, produces extremely exact glue patterns and needs inexpensive care and maintenance.

To achieve this object, the apparatus according to the invehtion is characterised in that the glueing region of the outer or peripheral face is provided with shallow depressions or recesses in which glue is received, and outside the glueing region formed in this way the outer or peripheral face is kept free of glue.

Glue is kept ready in the flat recesses or depressions as a result of feeding, for example as a result of dipping into a glue vessel, and, by contact of the glueing region with the blank to be supplied, is transferred onto the latter. A special feature of the invention is that the glue to be transferred onto the blank is not delivered to this under pressure. Instead, the blank rests against glue-free regions of the outer or peripheral face or against ridges, etc., in the glueing region. As a result of the connection of the free surface regions of the glue, some of the latter is drawn by the blank out from the recesses and depressions. A very exact glue transfer free of pressure thereby takes place.

The shallow recesses and depressions in the glueing region can be designed in various ways. A preferred embodiment of these consists of grooves, especially with a triangular cross-section. In the case of a glue-spreading member in the form of a glueing roll, these triangular grooves are arranged transversely in the glueing region and are delimited from one another by likewise triangular or trapezoidal ridges aligned transversely. Because of this sawtooth-shaped arrangement of the glueing region, rows of rectangular glue patterns are transferred onto the blank.

The outward-pointing tips of the ridges are flattened when these have a trapezoidal design.

Alternatively, the glueing region as a whole can consist of a continuous shallow depression which receives a thin uninterrupted glue layer and produces a corresponding glue pattern.

A scraper designed and arranged in a special way interacts with the glue-spreading member, meters the quantity of glue in the depressions, etc., and guarantees that outside the glueing region the outer or peripheral face remains free of glue. This also applies to ridges which in the glueing region project into the plane of the outer or peripheral face.

The glueing roll can be designed, according to the invention, with several, especially two, ribs which are delimited from one another and which form the outer and peripheral face and the glueing region. Furthermore, it is expedient to mount the glueing roll or several glueing rolls in a housing which because of its appropriate shape guarantees substantial sealing-off of the glueing space. Finally, it is envisaged, in the invention, that supporting rollers of a special shape should be assigned to the glueing rolls on the side located opposite the blank.

Figure 2:
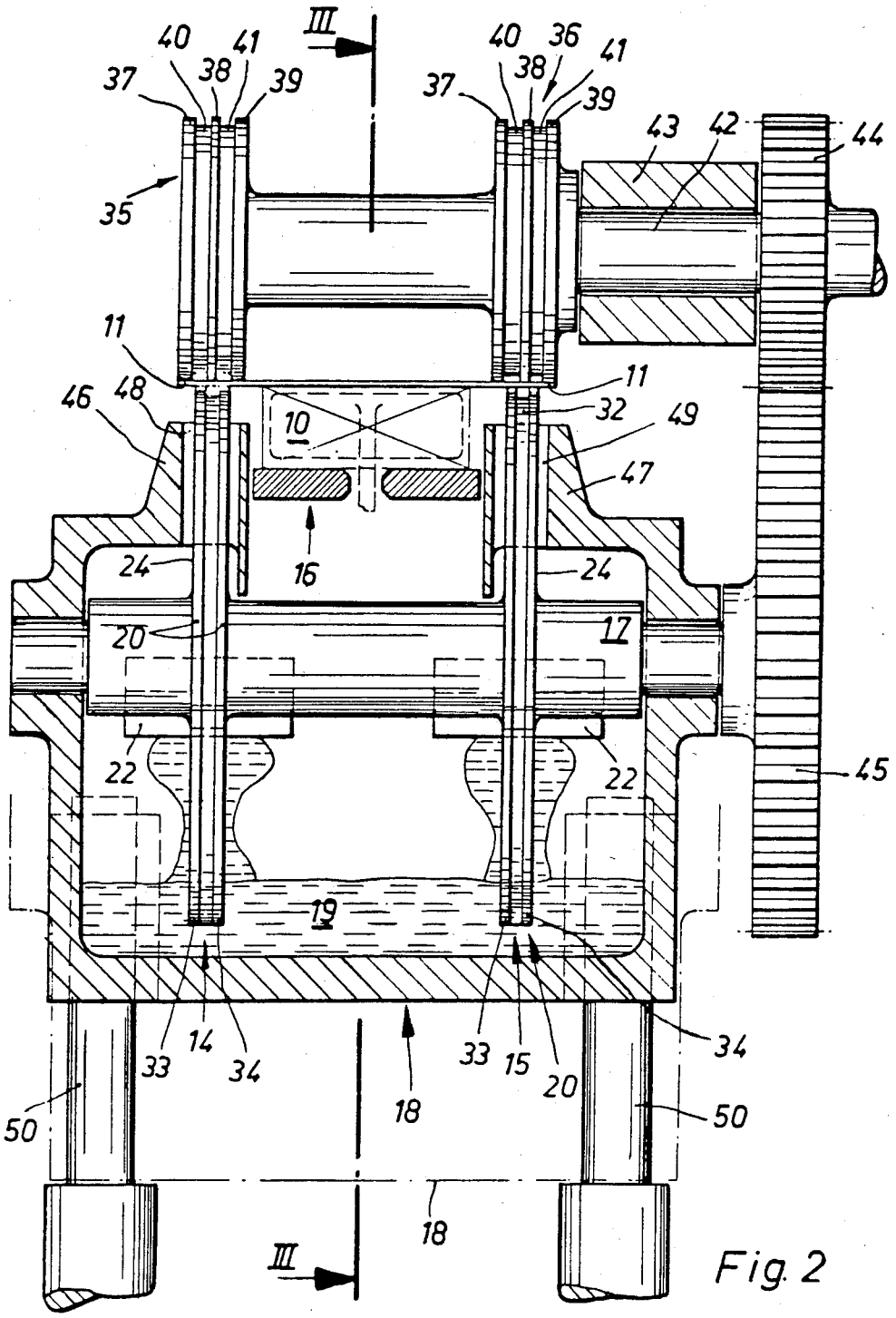
Figure 3:
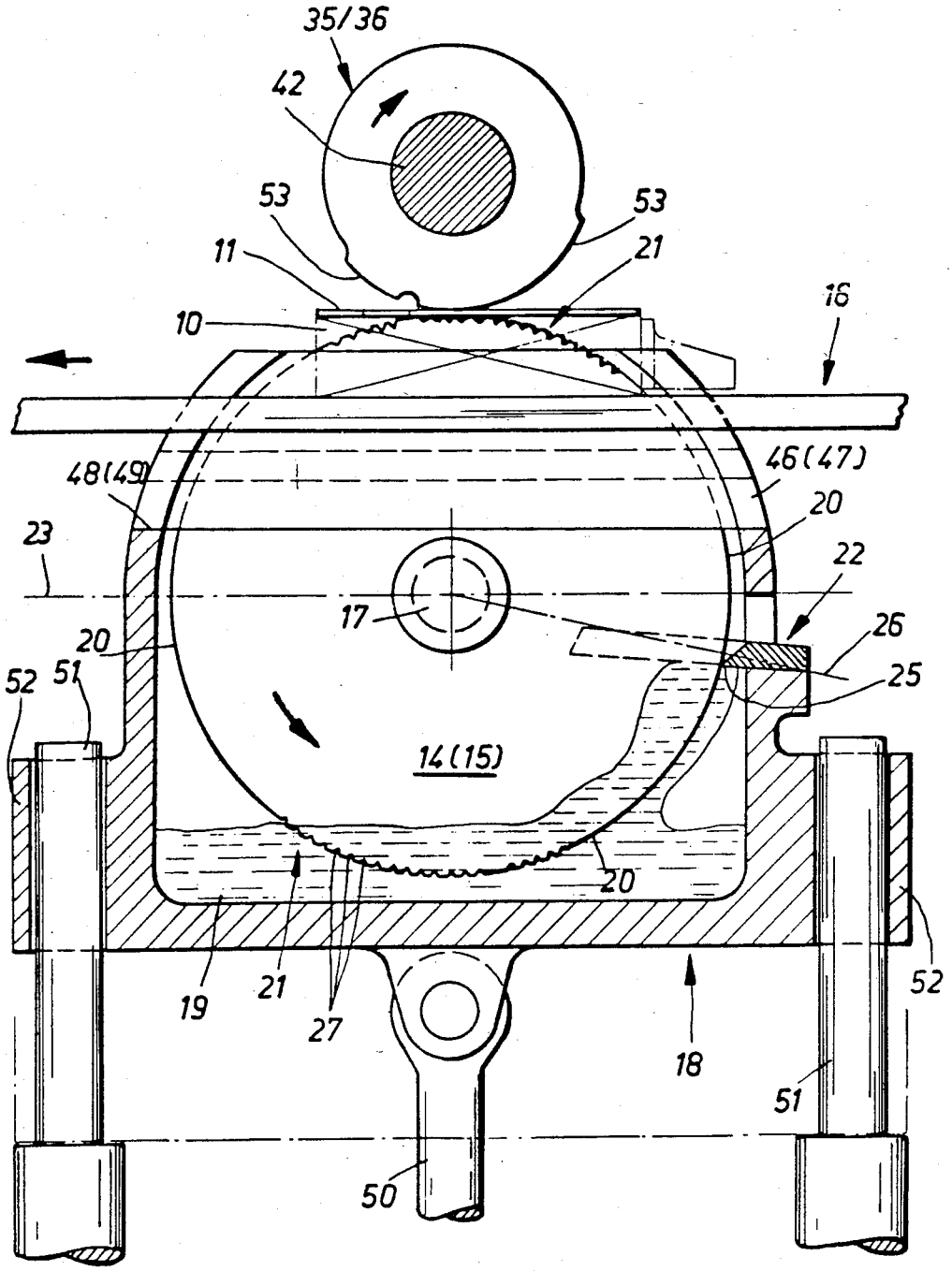
Figure 7:
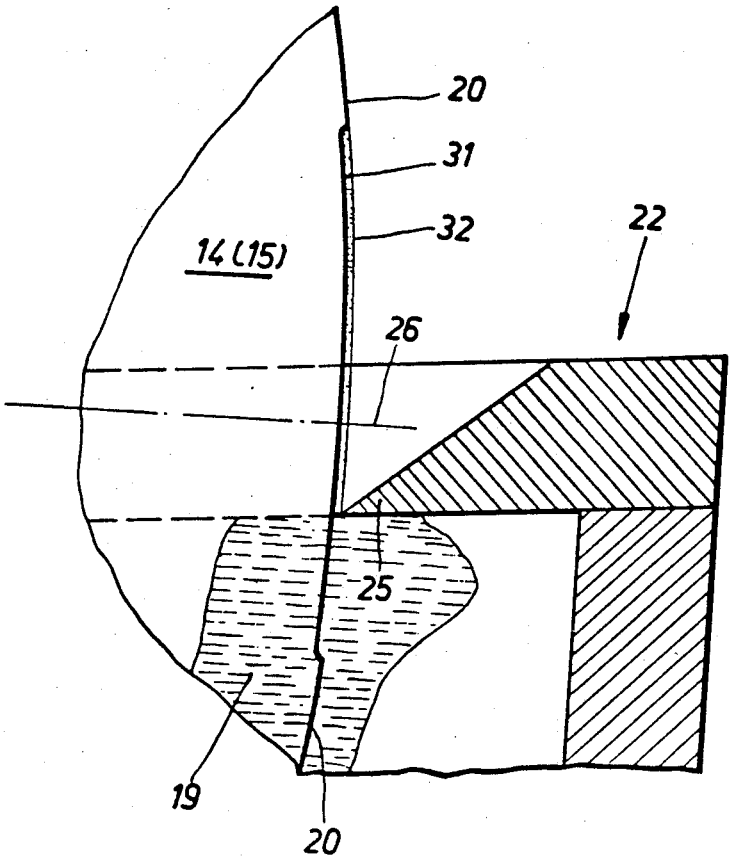

Exemplary embodiments of the invention are explained in more detail below with reference to the drawings in which:

FIG. 1 shows, in a plan view, a partially finished pack with glued tabs,

FIG. 2 shows, in a vertical section, an apparatus for spreading glue, for example onto a pack according to FIG. 1, FIG. 3 shows a vertical section III—III of FIG. 2, offset 90°, FIG. 4 shows a cut-out of a glueing roll on a greatly enlarged scale, FIG. 5 shows an illustration similar to FIG. 4 of another exemplary embodiment, FIG. 6 shows, in a plan view, a cut-out of the glueing roll, FIG. 7 shows a vertical section similar to FIGS. 4 and 5 of a further exemplary embodiment.

FIG. 1 shows, as a practical example, a plan view or bottom view of a cuboid pack 10. The pack 10 is virtually finished. In the arrangement shown, only side tabs 11 still have to be folded over against side faces. For this purpose, the transversely projecting side tabs 11 are provided on their undersides with glue which is applied, here, in the form of a special glue pattern 12. This consists of two rows of rectangular glue spots 13 which, when the side tabs 11 are laid against an opposing tab (not shown), run into a continuous strip of glue. The pack 10 is preferably used for receiving cigarettes.

The glue patterns 12 are applied in the region of a glueing appliance within a packaging machine. For this purpose, in the exemplary embodiment shown two glueing rolls 14, 15 are arranged below and next to a conveying track 16 for the packs 10. The glueing rolls 14, 15 are mounted rotatably on a common shaft 17 within a glue vessel 18. The arrangement is such that the glueing rolls 14, 15, an upper region of which projects from the glue vessel 18, come in contact with the undersides of the transversely projecting side tabs 11 when the pack 10 is conveyed on the conveying track 16 past the glueing rolls 14, 15.

The glueing rolls 14, 15 each dip with their lower regions into a supply of glue 19 within the glue vessel 18. As a result of the rotation of the glueing roll 14, 15, glue is constantly taken up, specifically primarily in the region of peripheral faces 20 of the glueing rolls 14, 15. These are provided with specially designed glueing regions 21, that is to say portions of the peripheral face 20, in regions of which glue is retained and transferred to the pack 10 or the side tabs 11. Outside the glueing regions 21, which correspond respectively to the dimensions of the glue patterns 12 to be transferred, the glueing rolls 14, 15 or the peripheral faces 20 are kept free of glue.

For this purpose, after coming out of the supply of glue 19, the glueing rolls 14, 15 move past a scraper 22 within the glue vessel 18. Here, this scraper is located below a horizontal centre plane 23 of the glueing rolls 14, 15 and in the outer peripheral region of each of these. The scraper 22 surrounds positively the region of the glueing roll 14, 15 to be treated, as is evident especially from FIG. 6, in such a way that the outer peripheral faces 20 and also the adjoining side faces 24 of the glueing rolls 14, 15 are cleared of glue. In the region of the peripheral face 20, the scraper 22 is designed with a scraping edge 25 which is sharpened, that is, ends in a sharp edge. This is positioned at an extremely short distance from the peripheral face 20 or the glueing regions 21. The relative arrangement of the scraper 22 is such that it does not lie in a radial plane 26 of the glueing roll 14, 15, but is offset or tilted relative to this, as a result of which a better scraping effect is achieved.

The glueing regions 21 are designed so that, despite the effect of the scraper 22, they carry glue with them and transfer it to the pack 10 or the side tabs 11. For this purpose, the glueing regions 21 are characterised by depressions or recesses in the peripheral face 20 of the glueing rolls 14, 15. These relatively shallow recesses and depressions can have different geometrical shapes.

In the exemplary embodiment according to FIG. 4, depressions approximately triangular in cross-section are let into the glueing rolls 14, 15, in such a way that these have correspondingly shaped transverse grooves 27. These are delimited from one another by ridges 28 also directed transversely. The ridges 28 have, here, a trapezoidal cross-section formed by a triangular cross-section with the apex taken off. In the exemplary embodiment of FIG. 4, ridge faces 29 formed in this way and pointing radially outwards are set back relative to the plane of the peripheral face 20, so that a thin glue film 30 formed in this region, that is to say between the grooves 27. The glue pattern 12 transferred onto the pack 10 or the side tabs 11 has a corresponding formation.

In the exemplary embodiment of FIG. 5, grooves 27, also triangular in cross-section, for receiving glue are arranged in the glueing region 21. The delimitations of these, namely ridges 28, here extend into the plane of the peripheral face 20. The ridge faces 29 are thus cleared of glue by the scraper 22. The glue retained solely in the grooves 27 results in a glue pattern 12 substantially in accord with the illustration in FIG. 1.

A further embodiment is shown in FIG. 7. Here, the glueing region 21 is formed by a single continuous shallow recess 31 in the peripheral face 20 of the glueing roll 14, 15. The radial depth of this recess 31 is so small that a thin glue film 30 is retained within the latter and a corresponding glue pattern 12 is transferred onto the pack 10. In the transverse or axial direction the glueing roll 14, 15 can be subdivided, in the region of the recess 31, by ridges or ribs extending in the peripheral direction, so that the transferred glue pattern 12 consists of strips.

In the present exemplary embodiment, the glueing rolls 14, 15 have a special design in that the outer periphery consists of two annular ridges 33, 34 separated from one another by a recessed portion 32. These consequently form peripheral faces 20 with glueing regions 21. The result of this is glue patterns 12 with pairs of glue spots 13 arranged in strips.

Corresponding supporting rollers 35 and 36 interact with the glueing rolls 14, 15, are mounted on the side of the side tabs 11 located opposite the glueing rolls 14, 15 and rest against these tabs. To accord with the shape of the glueing rolls 14, 15, the supporting rollers 35, 36 are designed with three annular ridges 37, 38 and 39 on the peripheral face 20. These are each located offset relative to the annular ridges 33, 34 of the glueing rolls 14, 15, in such a way that the latter rest against the side tabs 11 in the region of recessed portions 40, 41 of the supporting rollers 35, 36. As a result, these tabs are concave in the region of contact with the glueing rolls 14, 15.

The supporting rollers 35, 36 are arranged on a common shaft 42 which is held by a fixed bearing 43. The shafts 42 and 17 are moved by a common drive via suitably dimensioned gear wheels 44 and 45.

The glue vessel 18 is also designed in a special way, namely as a substantially closed housing. In the upper region, the glue vessel 18 is made in the form of a cap. The glueing rolls 14, 15 pass through top covers 46, 47 in the region of orifices 48, 49. As a result, the glue is protected against premature drying.

Furthermore, the glue vessel 18 is movable up and down as a whole, according to FIG. 3 by means of a lifting rod 50 engaging centrally. The exact position of the glue vessel 18 is guaranteed by vertical guide rods 51 on which the glue vessel 18 is mounted by means of sliding guides 52.

As a result of the up-and-down movement of the glue vessel 18, necessary work can be carried out on the glueing appliance. Moreover, in the upper position, a contact pressure can be set for contact of the glueing rolls 14, 15 against the side tabs 11. As a result of the contact of the glueing region 21 against the side tabs 11, not only is a superficial thin film of the glue delivered by the grooves 27 or the recess 31, but, rather, glue is also taken out from the depths of the grooves 27, etc. As a result, exact glue spots 13 with a sufficient quantity of glue are produced.

The supporting rollers 35, 36 producing the counterpressure are designed, here, with segments 53 as a contact face, that is to say the annular ridges 37, 38, 39 extend in the region of these segments 53.

I claim:

1. An apparatus for applying glue to laterally extending flaps of a partially formed package comprising a glue container, a first shaft rotatably mounted within the glue container, a pair of glue applying rollers mounted on said shaft in axial spaced apart relation, conveyor means extending orthogonally with respect to said shaft and located between said rollers for supporting a partially formed package having a pair of oppositely extending lateral flaps adapted to engage the peripheral surface of said rollers, a second shaft disposed parallel to said first shaft, a pair of backing rollers mounted on said second shaft in axial spaced apart relation with said backing rollers being opposed to said glue applying rollers for engagement with said flaps, means for rotating said first and second shafts, cover means for said glue container disposed on opposite sides of said conveyor means, said cover means having aperture means through which the outer periphery of said glue applying rollers extend, and means for separating said glue applying rollers and said backing rollers to facilitate cleaning and repair work.

2. An apparatus as set forth in claim 1 wherein each of said glue applying rollers is provided with an annular recess about the circumference thereof to define a pair of annular ridges each of which is provided with a pattern of glue receiving grooves on the circumference thereof.

3. An apparatus as set forth in claim 2 further comprising scraper means disposed adjacent each of said glue applying rollers for recovering excess glue, each of said scraper means having recesses for receiving said ridges whereby glue is scraped from the sides and the circumference of said ridges.

4. An apparatus as set forth in claim 2 wherein said pattern of glue receiving grooves on the circumference of each ridge is discontinuous in the circumferential direction.

* * * * *